US005497998A

United States Patent [19]

Horton

[11] Patent Number: 5,497,998

[45] Date of Patent: Mar. 12, 1996

[54] ROLL UP GAME BOARD AND METHOD FOR MAKING THE SAME

[76] Inventor: Walter J. Horton, P.O. Box 2873, Salt Lake City, Utah 84101

[21] Appl. No.: 306,634

[22] Filed: Sep. 15, 1994

[51] Int. Cl.[6] ..... A63F 3/00

[52] U.S. Cl. ..... 273/285; 273/286

[58] Field of Search ..... 273/155, 285, 273/286, 287; 428/12; 446/487

[56] References Cited

U.S. PATENT DOCUMENTS 538,380 4/1895 McKenzie ..... 273/286

827,670 7/1906 Russell ..... 273/286

*Primary Examiner*—William M. Pierce

[57] ABSTRACT

A tambour game board comprising of a series of adjacent rectangular segments each segment having a top and bottom horizontal surface and two side surfaces each being vertical to the top and bottom surfaces. Each segment consisting of a top surface such as veneer adhesively secured in a unidirectional concavity to the top surface of the substrate. Each segment having a veneered pattern which is an integral part of the whole intended design. Each segment having been cut from a single panel composition veneered substrate being no greater in thickness than ⅛" wherein each segment maintains its planarity or its original relationship to its mated adjacent segment. Each segment in a tight relationship to its mated adjacent segments are adhesively secured unidirectionally to the bottom surface of the substrate by a single sheet of flexible material such as fabric. Wherein, the tambour game board when fully constructed displays the intended pattern of the game and the interface between the mated adjacent segments is virtually without void and therefore when unidirectionally attached to the omni-directional flexible material provides for a board which when in the playing position lays flat and is rigid to provide for a firm and solid playing surface and yet when inverted, rolls or folds to a compact cylindrical shape for portability and or storage.

9 Claims, 7 Drawing Sheets

Fig 5b
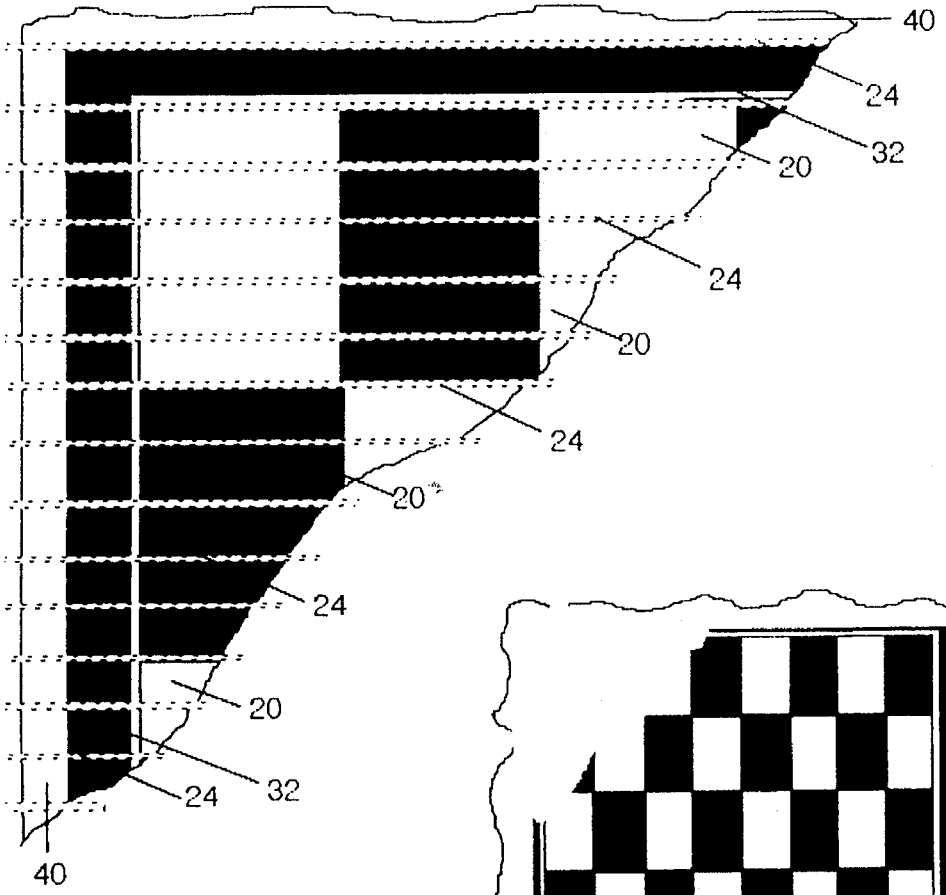
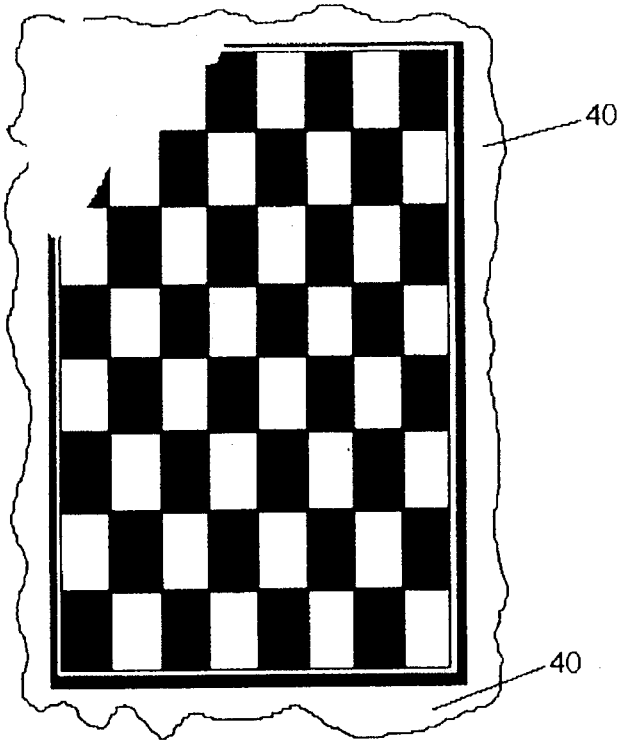
Fig. 5c

ROLL UP GAME BOARD AND METHOD FOR MAKING THE SAME

SUMMARY OF THE INVENTION

It is therefore the objective of the present invention to provide an attractive game board, one which when in use provides for a board which is of solid composition, which lays flat and is a rigid and therefore a stable playing surface. When inverted the game the board rolls or folds into a compact and portable unit.

More particularly, the present invention provides a tambour game board which is comprised of a plurality of elongated segments. Each segment on a planarity to its mated neighboring segment. Each segment having a top and bottom horizontal surface and two sides surfaces each being vertical to the top and bottom surfaces.

More particularly, each segment having been cut from a single panel whose thickness is no greater than ⅛". Wherein each segment maintains its original relationship to its mated adjacent segment. Each segment in this planarity tightly mated relationship to its neighboring segment is adhesively secured (unidirectionally to the cut lines of the segments) to a single sheet of flexible material, such as fabric.

More particularly, the present invention provides for a pattern of veneers adhesively secured to a single panel substrate whose pattern is a mathematically distorted representation of the intended game. This distorted representation being a formula based on intended size, number of desired segments, amount of kerf and placements thereof.

More particularly, the present invention provides for a single panel whose top surface being of a design which is distorted at specific intervals (dictated by desired number segments) for a distance equal to that of the necessary kerf at an exact 90 degree angle to that of the cutting tool. The picture than continues on until the next interval is reached where again the picture is distorted at a 90 degree angle to the cutting tool the distance amount of distortion being equal to that of the kerf and this repeats until the the entire composition panel has been cut.

More particularly, the present invention provides for the maintaining of the relationship of the cut segments to each other. The segments are treated as they are mated before cutting and placed back to their original relationship snugly fitted in their side-by-side relationship to eliminate the amount of void between segments.

More particularly, the present invention provides for these mated parallel segments in a tight conformity to each other be adhesively secured in a unidirectionally to omnidirectional flexible material such as some fabric. This transverse directioning provides for a no give in the fabric as it is placed parallel to the direction of the length of the segments. And therefore when layed face up provides for a board which is of a rigid and solid composition and when inverted will roll or fold.

More particularly, the present invention utilizes flexible fabric material which is of wool nylon blend for when the edges are trimmed a burning is done to the edge of the solid composition board the oils in the wood when heated against a hot knife caramelize to a browned sealed finish and the wool nylon blend of the desired fabric against the hot knife cauterizes the fabric and perverts from any freighting after when in use.

More particularly, the present invention is constructed of solid materials each adhesively secured to the the other with permanate bond strength adhesive and therefore creates a solid composition board with a life expectancy of the materials from which it is constructed wood, wool, nylon, permanent adhesive the finish to be applied after proper sanding to seal the whole.

BRIEF DESCRIPTION OF DRAWINGS

A better understanding of the invention will be had upon reference to the following description in conjunction with the accompanying drawings wherein like numerals refer to the parts throughout the several views and in which:

FIG. 4*a* same view as FIG. 4 with flexible material in relationship to.

FIG. 5*b* is a top view of the tambour game board with corner out showing prospective referencing cut lines.

FIG. 5*c* is a top view of the tambour game board as a checker board might appear prior to cutting.

BRIEF DESCRIPTION OF PREFERRED EMBODIMENTS

With reference to FIGS. 1–3 and 7–8 , there is shown a tambour game board generally denoted by the numerical 10, of the present invention when in the playing position is a rigid surface universally planar, of a solid composition construction and yet when inverted rolls or folds to a compact shape for portability or storage.

Figure 1:
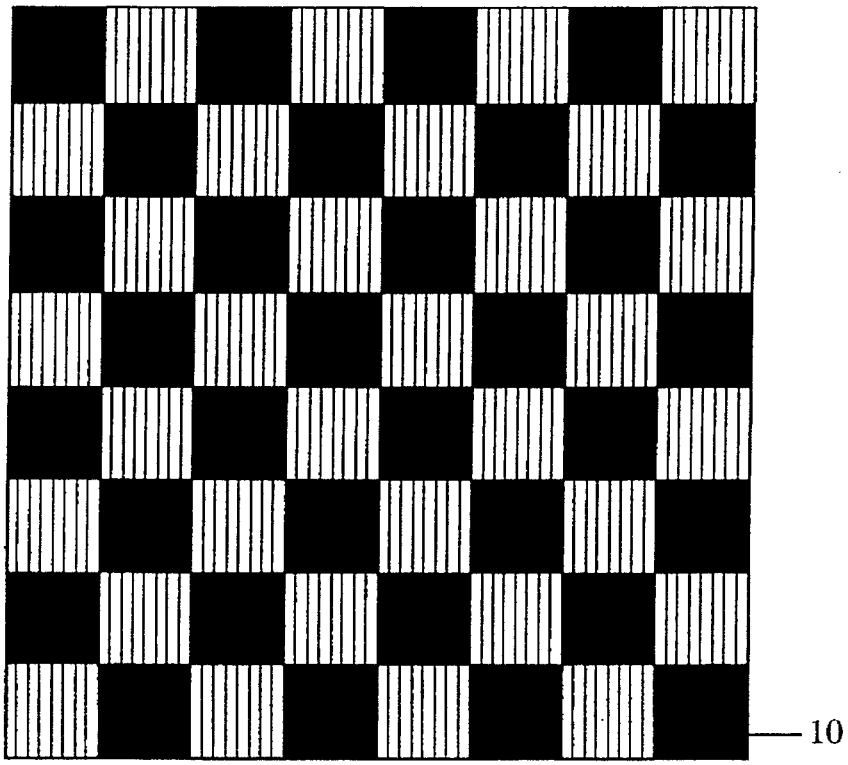
FIG. 1 is a top view of the tambour game board as it would appear in the playing position.
Figure 2:
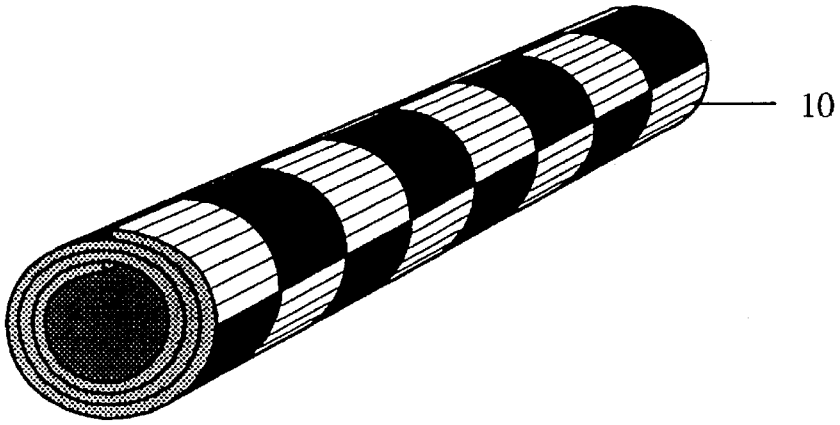
FIG. 2 is a perspective view of the tambour game board as it would appear when inverted and rolled to a tight cylindrical shape.
Figures 3, 3A:
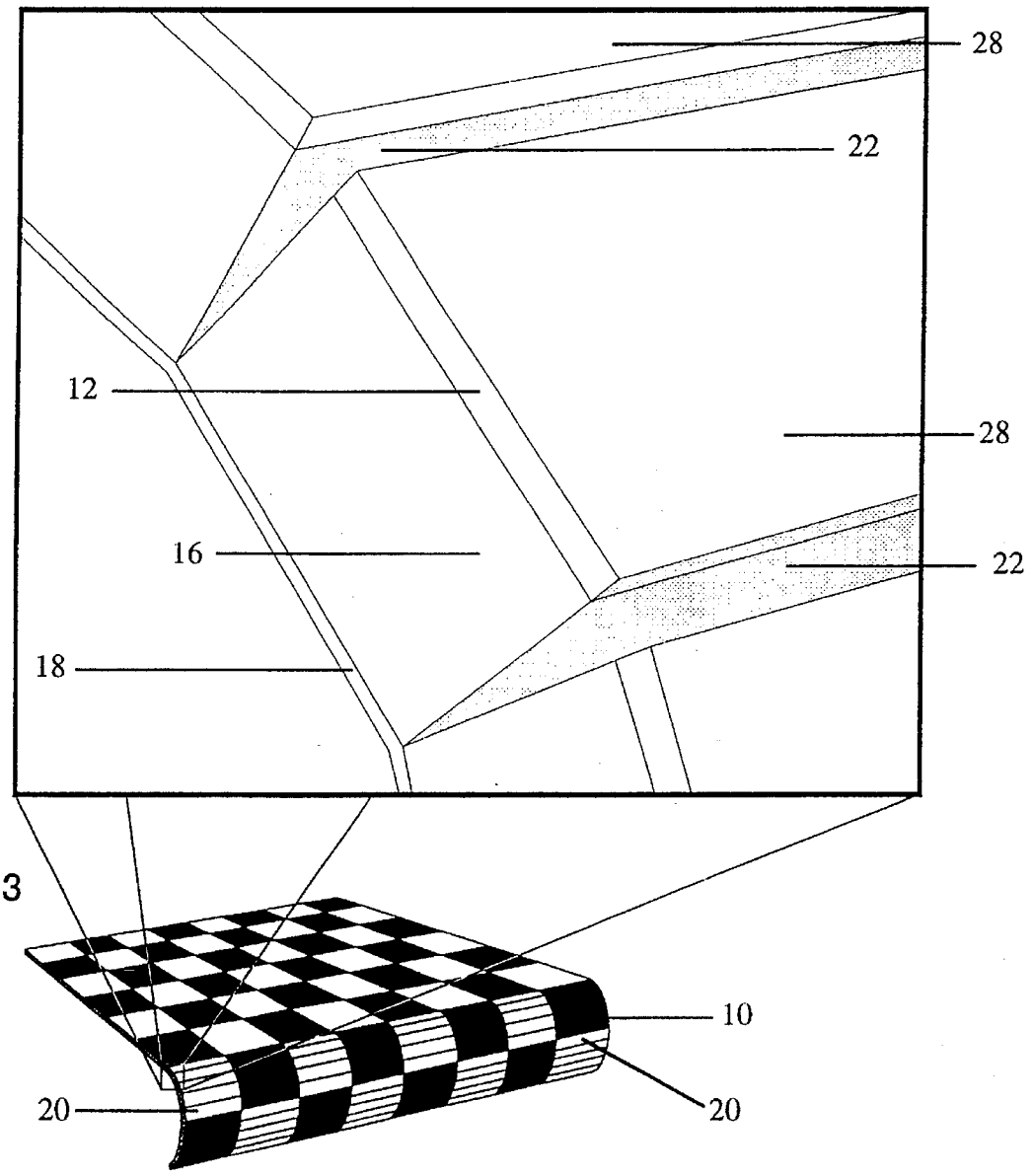
FIG. 3 is a perspective view of the tambour game board partially turned under and an enlargement of the segments as they appear when.
Figure 4:
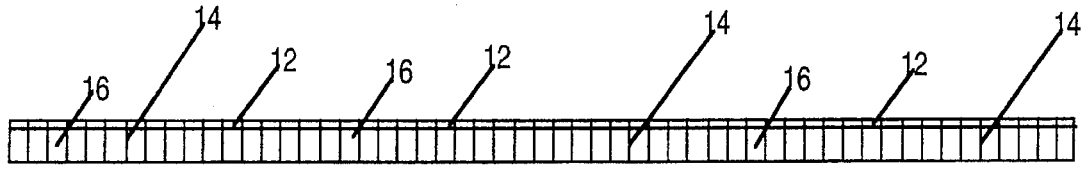
FIG. 4 is a side view of the tambour game board as it appears as a cut composition panel of veneers and substrate.
Figure 4A:
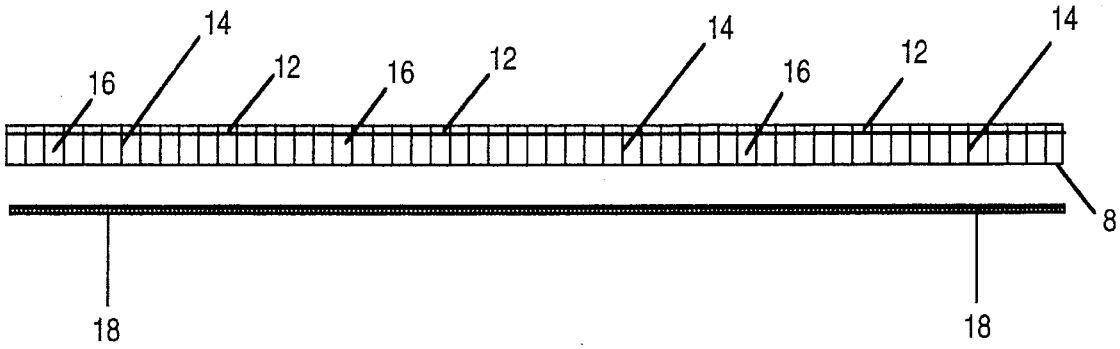
Figure 4B:
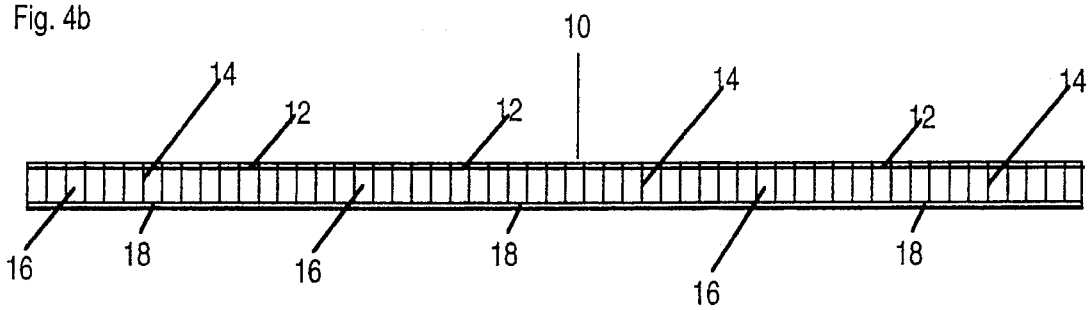
FIG. 4*b* Tambour game board as it would appear after complete construction.

Toward this objective, FIGS. 3 and 4*b* the tambour game board 10 comprises of a series of rectangular adjacent segments 20. Each segment having a horizontal top surface 28 and bottom surface 18 and two side surfaces 22 each being vertical to the top surface 28 and bottom surfaces 22 FIG. 3. Each segment consisting of a top surface such as veneer 12 adhesively secured in a unidirectional concavity 36 to the substrate 16, FIGS. 6*a*.

Figure 5:
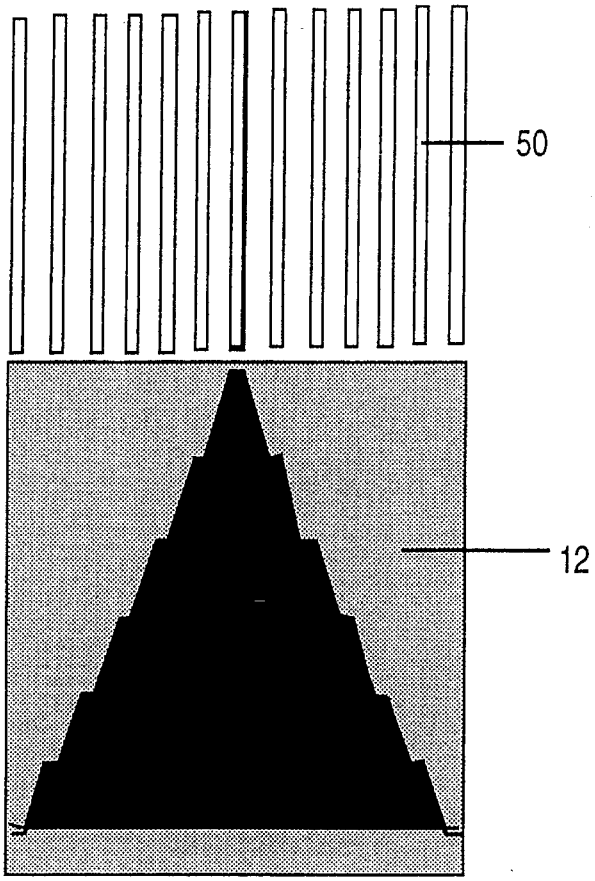
FIG. 5 is a top view of the tambour game board as it might appear before being cut for a triangular pattern.
Figure 5A:
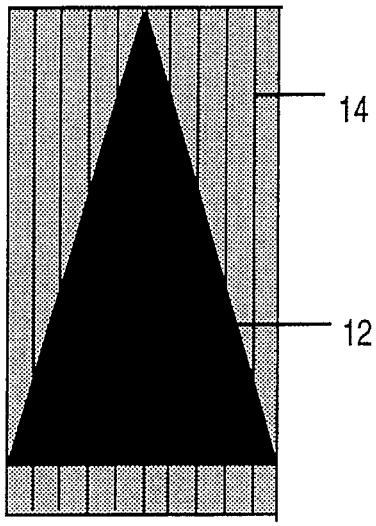
FIG. 5*a* is a top view of the tambour game board as it would appear after cutting, after cutting and segments are realigned (the intended design).

The pattern is layed up and is a distorted representation of the intended or desired design. The calculations for establishing the distorted size is as follows: With Y=Kerf(Material Loss), Z=Desired size(over all size of game board after completion), Desired overall size divided by the desired number of segments which=X. Then X−1 multiplied by Y (kerf) plus Z (Desired size) equals Distorted overall size. The distortion happens at intervals equal to X and regardless of pattern distorts FIG. 5 for a distance equal to that of Y at an exact 90 degree angle to cutting tool 50 FIG. 5. What is accomplished is the desired pattern FIG. 5*a*, when the segments are remated to their original side-by-side relationship after cutting the pattern which remains is the intended design, FIG. 5*a* and FIG. 1.

Figure 6:
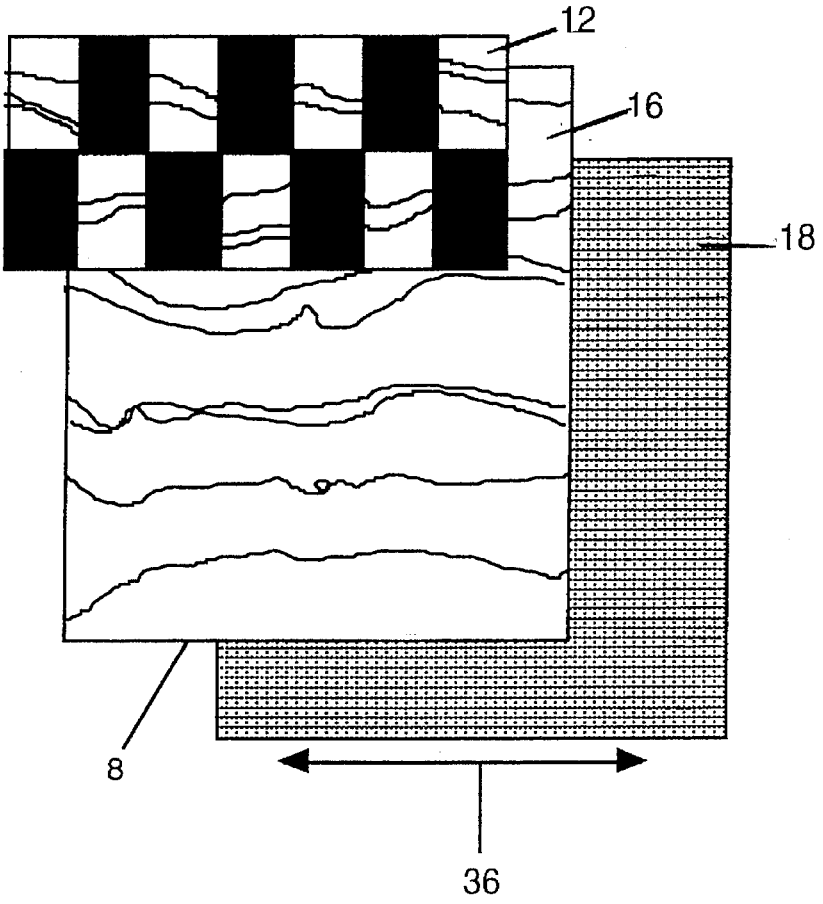
FIG. 6 is a top view of unidirectional placement in construction.
Figure 6A:
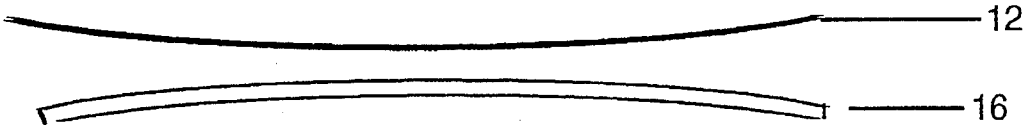
FIG. 6*a* is a side view of the veneer top surface and substrate bottom surface.

The veneer picture is adhesively secured to the substrate in a unidirectional concavity to each other FIG. 6*a*. The composition's direction of the veneer and substrate are matched FIG. 6.

The tambour game board as it appears before cutting is shown in FIG. 5*c*. FIG. 5*c*, taking notice of a checker board as it might appear, being ready to be cut, and the rectangular rather than square shape of the design as show in FIG. 5*c*, a corner section of FIG. 5*c* shown as FIG. 5*b* is provided in large scale to show a more detailed example to the referencing of segments 20 in their relationships to each other respective to before and after being cut as well as the cut lines 24 and their respective relationships to each other and segments as well as design and the respective relationship it has to segments 20 and cut lines or kerf 24. FIG. 5*b* also shows a boarder 32 and its construction thereof in the relationship to design pattern segments 20 and kerf lines 24. In FIG. 5*b* and 5*c* the composition veneer substrate panel is represented by the numerical 40 with the veneered pattern as it would appear before being cut. Each individual segment emerges after cutting with its own pattern one which is an integral portion of the whole intended design. Now having displayed the before with all segments remaining in their original mated planar adjacent relationship to each other and snugly placed in their mated adjacent relationship to each other the intended design appears FIG. 1. In FIG. 4 now is present is a end view of a series of planar placed, snugly fitted of the composition segments. The snugness of the segments is to eliminate any voids between segments as shown in FIG. 4 where we have Veneer 12 adhesively attached to substrate 16 with interface 14.

Figure 7:
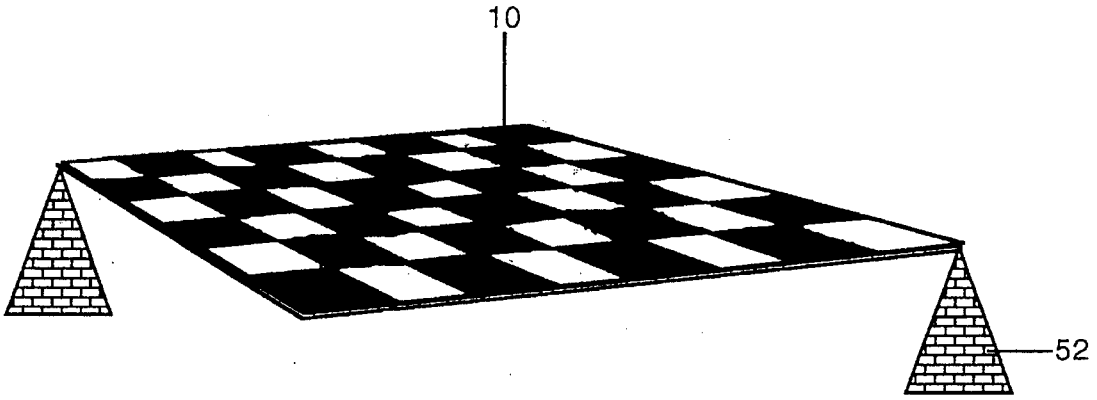
FIG. 7 a top perspective view of the tambour game board as it appears when when the tambour game board is resting on two points in opposite corners and is rigid.

By adhesively securing a a flexible material 18 to the bottom side 8 of substrate 16 in a unidirectional relationship to substrate 16 provides for a no give resistance to the tambour game board 10 FIG. 4*b*. The lack of voids at interface 14 between segments 20 and the no give by directional placement of the fabric provides for a flat, rigid board 10 which when supported on opposite parallel ends to cut lines. FIG. 7 (where two blocks are shown suspending the tambour game board). The no give resistance which is referred to in the last sentences is due to the flexible material itself fabric. For due to the weave itself fabric will stretch and give in the direction of the weave with no give when pulled cross-grain to weave direction. Fabric which is woven unidirectional and therefore by placing the direction of the weave in the direction of the rectangular segments 20 which is equal to the grain direction of the substrate FIG. 6, the fact that there is no give to the fabric after it is placed and adhesively secured to the bottom surface 8 of substrate 16 in FIG. 6. In this fashion of placement it assures a lateral no give resistance to segments 20 FIG. 4*b* and segments 20 remain snugly mated to each other to provide for a rigid game board FIG. 7.

The cutting up of the composition veneer design and substrate panel is most efficiently accomplished by the method known as gang-ripping where a series of blades all running consecutively cut the material at the desired width. Another means of cutting would be by lacing a frame with a wire which is coated with a light abrasive the material to be cut would come into contact with the abrasive wire and through means of a high speed back and forth movement work its way through the material.

It is the object of this invention to always produce in the most efficient manner possible with respect to raw materials, the minimizing of kerf loss always being the first consideration.

Figure 8:
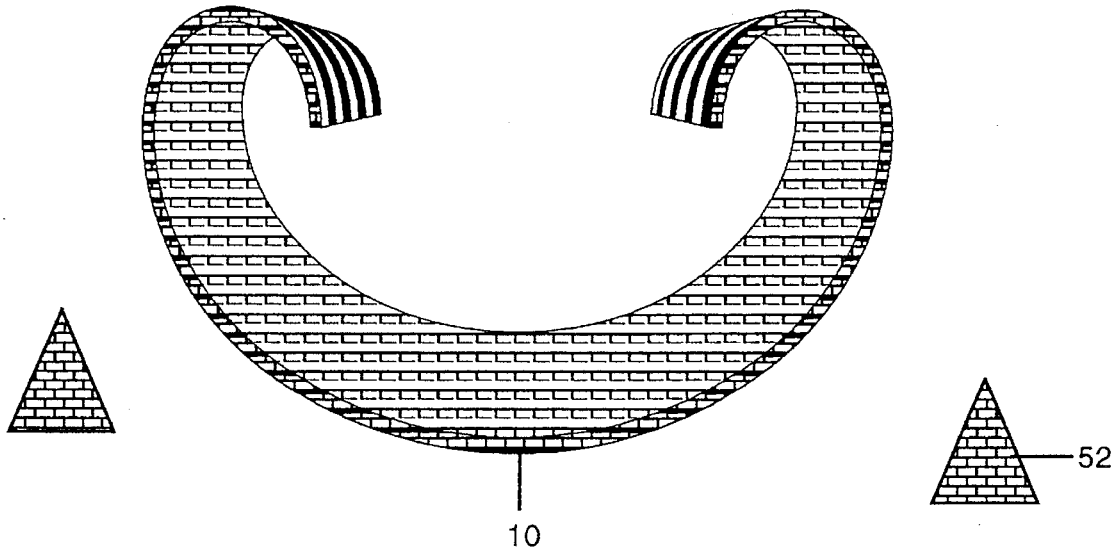
FIG. 8 a side perspective view of the tambour game board as it appears when inverted from the playing position.

When the tambour game board is complete in its construction it is a solid composition board which is rigid when face up flat and when inverted from this position rolls or folds FIGS. 7 and 8.

When edges are trimmed of fabric 18 it is desirable to finish of edges of tambour game board 10 by burning with a hot knife. This process seals the wood due to its properties and cauterizes the fabric to prevent the fabric from fraying when in use.

I claim:

1. A game board comprising;

a series of adjacent rectangular segments, each segment having a top and bottom horizontal surface and two side surfaces each being vertical to the top and bottom surfaces, a sheet of flexible material having the bottom surfaces of said series of segments adhered thereto such that the side surfaces of the segments abut one another in a side by side relationship, said top surfaces of said segments having game indicia applied thereto, whereby the game board maintains a rigid existence when supported in one direction and is flexible when supported from another.

2. A game board as called for in claim 1 in which said game indicia is a second layer veneer-type surface having a thickness.

3. A method of making a game board comprising the steps of;

providing a substrate, providing a panel having game indicia thereon, applying said panel to said substrate, cutting said panel and substrate into individual elongated segments at preestablished intervals such that each has a top and bottom surface which is horizontal to the two side surfaces, providing a sheet of flexible material and applying the bottom surfaces of said segments to the sheet in an abutting side by side relationship.

4. A method of making a game board as recited in claim 3 where said panel is less than ⅛ of an inch in thickness.

5. A method of making a game board as recited in claim 3 where said panel provided is a photograph.

6. A method of making a game board as recited in claim 3 where said panel is printed material.

7. A method of making a game board as recited in claim 3 where the step of applying requires the use of an adhesive.

8. A method of making a game board as recited in claim 3 where said substrate is selected from solid wood, plastic or of a synthetic material.

9. A method of making a game board as recited in claim 3 where said indicia is provided with a distortion means to compensate for the removal of material during cutting such that the intended design is displayed during the step of applying said segments to said sheet material.

* * * * *